United States Patent [19]

Lehmann

[11] 4,452,348

[45] Jun. 5, 1984

[54] SUITCASE WITH BAND ELEMENT FOR CONCEALING BUTT JOINT BETWEEN UPPER AND LOWER PARTS THEREOF

[76] Inventor: Karl G. Lehmann, Geschw.-Scholl-Str. 26, 5042 Erftstadt-Lechenich, Fed. Rep. of Germany

[21] Appl. No.: 258,594

[22] Filed: Apr. 29, 1981

[30] Foreign Application Priority Data

Apr. 30, 1980 [DE] Fed. Rep. of Germany ..... 3016621

[51] Int. Cl.[3] ..... A45C 13/00; A45C 13/36

[52] U.S. Cl. ..... 190/122; 190/28; 190/125

[58] Field of Search ..... 190/28, 49, 41 C, 54, 190/121 US, 122 US, 125 US

[56] References Cited

U.S. PATENT DOCUMENTS 3,698,522 10/1972 Aronoff ..... 190/54 X

FOREIGN PATENT DOCUMENTS 2434324 1/1976 Fed. Rep. of Germany .... 190/41 C
2658454 6/1978 Fed. Rep. of Germany ..... 190/49
1452331 10/1976 United Kingdom ..... 190/49
2031853 4/1980 United Kingdom ..... 190/49

OTHER PUBLICATIONS

Published Abstract of Belgium Patent #879,137, Oct. 2, 1979, Superior SA (Castanier et al.).

*Primary Examiner*—William Price
*Assistant Examiner*—Sue A. Weaver
*Attorney, Agent, or Firm*—Watson, Cole, Grindle & Watson

[57] ABSTRACT

A suitcase which includes a lip element along the abutment edge of the lower part of the suitcase so as to circumvent the suitcase and form a seat for the abutment edge of the suitcase upper part, the lip element including a portion which extends outwardly with respect to the suitcase to mount a flexible plastic band element which itself extends circumferentially around the suitcase. The plastic band element, which can include an embedded metal foil, is shaped to contact and seal against the upper and lower parts of the suitcase when they are positioned together to close the suitcase, and thus also to hide the butt joint when the suitcase is closed.

13 Claims, 5 Drawing Figures

Fig.1
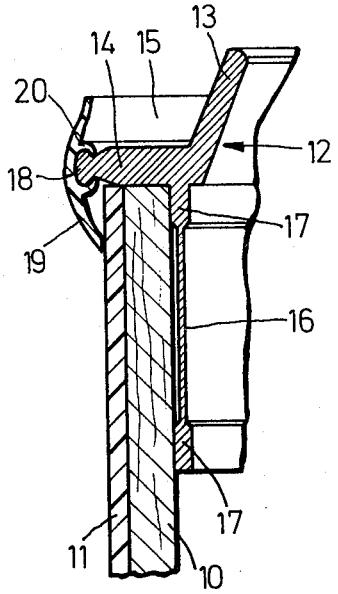
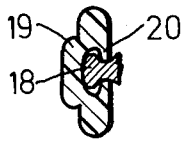
Fig.2
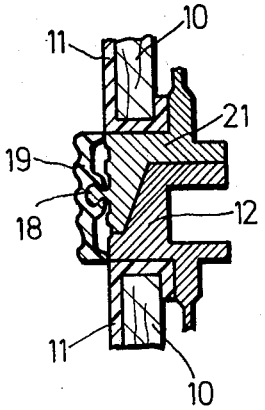
Fig.3

SUITCASE WITH BAND ELEMENT FOR CONCEALING BUTT JOINT BETWEEN UPPER AND LOWER PARTS THEREOF

BACKGROUND OF THE INVENTION

1. Field of the Invention

The present invention relates to suitcases, and more particularly to suitcases which include elements mounted circumferentially around the abutment edge of the lower part of each suitcase so as to form a seat for the abutment edge of the upper (lid) part of the suitcase when the suitcase is closed.

2. The Prior Art

Suitcases which are constructed to include plastic elements mounted circumferentially around the abutment edge of the lower part so as to form a seat for the abutment edge of the upper (lid) part of the suitcase when the suitcase is closed are known. For example, Published German Patent Application No. 26 58 454 discloses a suitcase which includes elements which are mounted on the lower part of the suitcase to circumvent the suitcase, one element forming a seat for the upper (lid) part of the suitcase, another element forming an angled portion, and another element forming an outer cover portion for supporting a separate metal strip capable of improving the looks of the suitcase by concealing the butt joint which is formed between the abutment edges of the upper and lower parts of the suitcase when the suitcase is closed. The elements are suitably fastened by the use of seams or the like. However, this prior art suitcase is quite expensive, insofar as quite a number of elements are needed adjacent the abutment edges, and the procedure for fastening them together is complicated.

Suitcases are also known which include aluminum elements postioned to cover and seal the butt joint of a suitcase. These elements are usually double T-shaped and include a covering strip which, after it has been fastened to the outer surface of the suitcase, extends along the circumference thereof and forms, together with the other elements, two U-shaped grooves. One of the grooves will fit over the abutment edge of the lower part of the suitcase (including its outer covering material) and the other will receive the abutment edge of the upper (lid) part of the suitcase when the suitcase is closed. However, the elements must be bent so as to form a circumferential element, and this procedure is difficult, i.e., it can be achieved only with great effort. In this regard, heavy bending machines are required and the sections must be first processed in an unhardened state. The individual sections can be hardened only after being bent. Thus, although this type of suitcase provides a pleasing appearance, it is not currently in production.

The primary object of the present invention is to provide an easily fabricated suitcase which includes simple elements which will contact the upper and lower parts of the suitcase and form a seal therebetween and also conceal the butt joint.

SUMMARY OF THE INVENTION

According to the present invention, the suitcase, which includes a lower part and an upper (lid) part, also includes a circumferential lip element which is shaped to form a seat for the abutment edge of the upper edge and to provide an outwardly directed mounting portion on which a flexible plastic band element is connected, this plastic band element being capable of contacting the external sides of the upper and lower parts of the suitcase when it is closed and thus forming a seal therebetween, as well as concealing the butt joint between the abutment edges of the upper and lower parts of the suitcase when the suitcase is closed.

The noted plastic band element also provide a pleasing appearance to the suitcase as a whole. In this regard, the plastic band element can be dyed so as to have any desired color. In addition, or alternatively, a metal foil can be embedded therein to provide the appearance of a circumferential metallic strip positioned around the butt joint. Such a metal foil, possibly made of aluminum, can be itself uncolored, or else it can be coated with a colored material, e.g., it can be a brass or bronze colored metal foil. The colored plastic band element can also be formed of a dyed plastic and have an aluminum foil embedded therein.

The circumferential lip element used in the invention, which may be made of plastic (possibly PVC) or aluminum, can be easily bent into the required shape before the plastic band element is attached thereto. Thus, the technique of fastening the lip element and the plastic band element to the suitcase frame is very simple. Also, only one lip element is needed for the various types of plastic band elements (which may vary with regard to color, shape, width, etc.), which makes production of the inventive suitcases very simple.

In addition, the plastic band element can be used to conceal the devices used for attaching the normal covering materials to the suitcase frame, allowing these devices to be rivets or clamps (instead of the conventional chain stitching which is expensive). The covering materials may also be attached to the suitcase frame by gluing.

A further understanding of the invention will be achieved by reference to the attached drawings taken in conjunction with the ensuing discussion.

DESCRIPTION OF THE DRAWINGS

In the drawings,

FIG. 1 shows a cross sectional view of the abutment edge area of the lower part of a suitcase constructed in accordance with one embodiment of the present invention, the suitcase including one form of lip element and associated plastic band element;

FIG. 2 shows a cross sectional view of an alternative construction of plastic band element which can be used in the suitcase of FIG. 1;

FIG. 3 shows a cross sectional view of the abutment edge areas of both the lower and upper parts of a suitcase constructed in accordance with another embodiment of the present invention, the suitcase including two lip elements and the plastic band element having a further modified form.

DETAILED DESCRIPTION OF THE PREFERRED EMBODIMENTS

Figure 4:
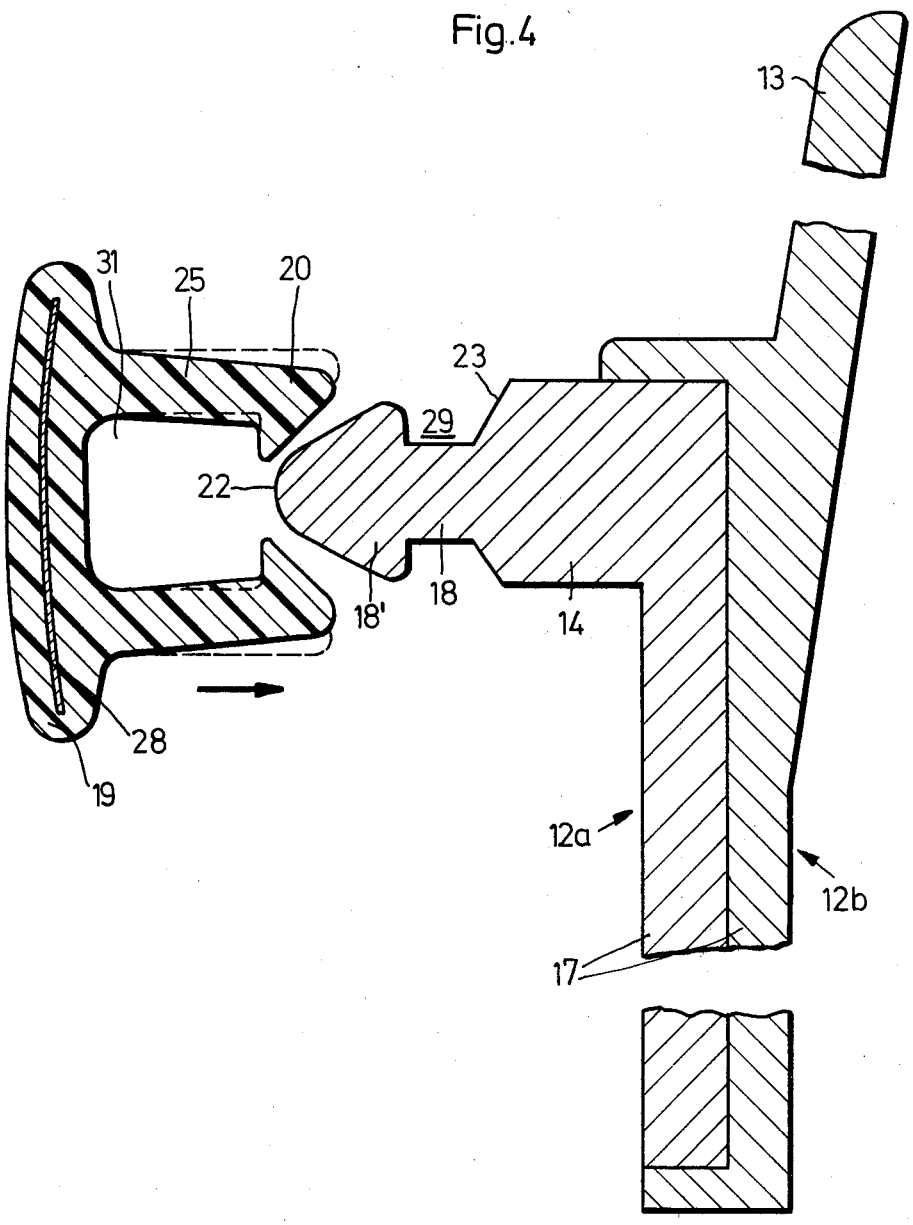
FIG. 4 is an enlarged cross sectional view of an additional form of lip element and plastic band element useful in the suitcase of the present invention.

According to the present invention, the suitcase includes a lower part and an upper part, and each part includes an underlying frame part 10 and an external covering material 11 (see FIGS. 1 and 3). The frame part 10 of each part may be composed of wood, plywood, cardboard, plastic or like materials while the external covering material may, for example, be composed of imitation leather. The external covering material 11 can be connected to the frame 10 in FIG. 1 by stitching, gluing, a chain stitch, or the like.

Considering in detail the suitcase embodiment shown in FIG. 1, it can be seen that a lip element 12 is positioned at the upper end of the frame part 10 of the lower part of the suitcase (as well as the upper end of the external covering material 11) to thus form the abutment edge, this lip element thus extending circumferentially around the suitcase. This lip element, which can be composed of plastic, aluminum or an aluminum alloy, includes a base leg portion 14 which contacts the upper ends of both the frame part 10 and the material 11, a slanting leg portion 13 which extends away from the inner end of the base leg portion 14 (and thus to extend upwardly and inwardly into the interior of the suitcase), and a supporting leg portion 16 which extends downwardly and along the inner side of the frame 10, this supporting leg portion 16 including thickened areas 17 at its upper and lower ends which are supported against the frame part 10. The lip element 12 is fastened in a common way to the frame part 10 by affixing the fittings (not shown) and possibly by use of additional fastening elements such as rivets or by seams. The base leg portion 14 and the slanting leg portion 13 together form a seat area 15 in which the abutment edge of the upper part of the suitcase can fit. The base leg portion 14 includes a portion which extends outwardly of the suitcase and beyond the external covering material 11, this portion terminating with a bulbous tip 18. This bulbous tip 18 functions to mount a plastic band element 19.

The plastic band element 19, which is flexible in shape, is curved in contour so that its lower end will contact and form a seal with the external covering material 11 of the lower part of the suitcase and its upper end will contact and form a seal with the external covering material of the upper part of the suitcase (not shown) when the upper part contacts the lower part to close the suitcase. Thus, when the suitcase is closed (the upper part being positioned in the seat area 15), the formed butt joint therebetween will be concealed. The side of the band element 19 facing the suitcase includes two spaced apart legs 20 which extend towards one another and thus can function to grip the bulbous tip 18 of the base leg portion 14, whereas the opposite side of the band element will be smooth. As shown in FIG. 2, the opposite side of the band element may alternatively include a raised central rib portion.

Referring now to FIG. 3, the inventive suitcase may alternately be constructed to include a first lip element 12 positioned at the upper end of the lower part of the suitcase and a second lip element 21 positioned at the lower end of the upper part of the suitcase, the lip elements 12 and 21 being shaped so as to suitably mate with one another when the suitcase is closed. In this embodiment the external covering materials 11 extend over the ends of the associated frame parts 10 and back along their inner sides and are suitably attached thereto, e.g., via tacks (not shown). In addition, in this embodiment it is the second lip element 21 which includes a mounting portion which extends outwardly of the suitcase to terminate with a bulbous tip 18. The band element in this embodiment includes a surface opposite the surface from which the legs 20 extend which has a corrugated contour.

An additional form of lip element and band element useful in the suitcase of the invention is shown in FIG. 4. In this embodiment the band element 19 is seen to include an embedded metal foil 28 and the terminal ends of the legs 20 include projections 25 which extend towards one another. On the other hand, the lip element 12, when being formed of two separate parts, includes an inner portion **12*b*, which is preferably composed of aluminum, and an outer portion 12*a*, which is preferably composed of plastic (e.g. polyvinyl chloride). The outwardly extending portion of the base leg portion 14 (which is part of the outer portion 12*a*), includes a bulbous tip 18' which is shaped in cross section like an isosceles triangle which has rounded corners (e.g. note the curved end face 22), and the portion between the bulbous tip and the main part of the base leg 14 is reduced in thickness, thus forming a groove portion 18''. The walls 23 of the main part of the base leg 14 facing this groove portion slant downwardly and upwardly, respectively, as shown. The band element 19 supports against the slanting walls 23 when the legs 20 are snap-fitted over the bulbous tip 18', preferably leaving a spacing 29 between the inner sides of the projections 25 and the slanting walls 23 so that the band element 19 can extend outwardly especially at the rounded corners of the suitcase to accommodate to these corners. Thus, it is not only possible to accommodate curves in the suitcase frame, but also different thicknesses of the frame (if the frame is made of plywood it may be 4 mm thick, whereas if made of plastic it may be 5 mm thick). Glue (e.g. a butyl sealer) can advantageously be used in the space 31 left between the inner side of the band element 19 and the bulbous tip 18'**.

Figure 5:
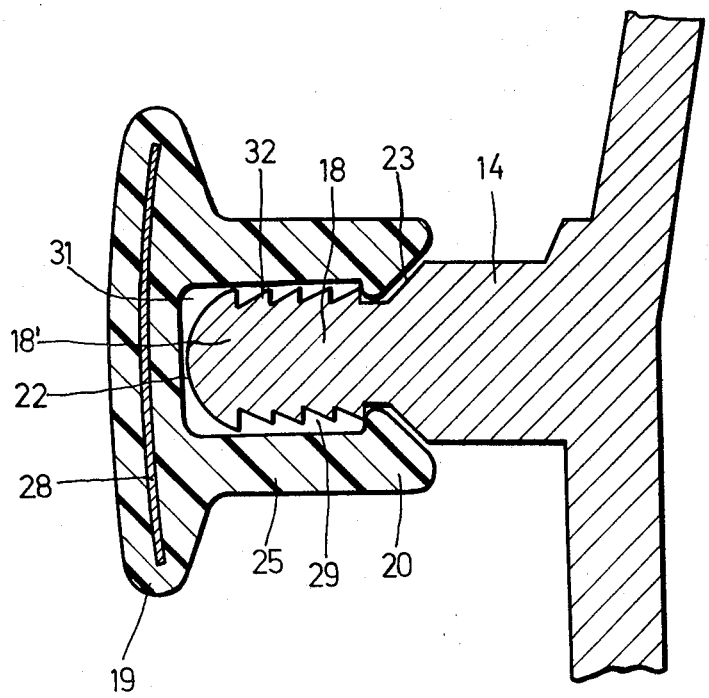
FIG. 5 is an enlarged cross sectional veiw of a lip element and a still further form of plastic band element useful in the suitcase of the present invention.

Referring now to FIG. 5, the bulbous tip 18' has a semicircular end face 22 in cross section and is separated from the groove 18'' by an elongated portion 18''' which has spaced apart ribs 32 on both sides therealong and of saw-tooth-like cross section, the ribs extending away from the portion 18''' less than corresponding part of the bulbous tip 18'. Thus, these ribs can be used to adjust the positioning of the band element 19 with respect to the frame 10 and thereby help compensate for tolerances of the thickness of the suitcase frames.

As in FIG. 3, the lid edge in the case of FIGS. 4 and 5 may be provided with a corresponding profile, like the profile 21 (with a corresponding fit of the profiles which mesh with one another when the suitcase is closed) so that, when aluminum is used for this profile, the lid frame need not be made of plywood to achieve sufficient strength, but may consist of cardboard, with a correspondingly small wall thickness.

It should be realized that the band element can be either symmetrical or asymmetrical in shape with respect to the legs 20 and the elongated portion 18''' can in fact have an increasingly thicker cross section as it extends towards the base leg portion 14.

I claim:

1. A suitcase which comprises a lower part and an upper part, each of said lower and upper parts including a frame means which has an inner surface that defines the interior of the suitcase and an outer surface, and each of said lower and upper parts providing an abutment edge, the abutment edges defining therebetween a butt joint which extends circumferentially around the suitcase when said upper part is positioned in close proximity to said lower part so as to close the suitcase, a lip element connected to said lower part and positioned to extend over the entire abutment edge of said lower part, said lip element being elongated so as to extend circumferentially around the suitcase, said lip element including a base leg portion which contacts the abutment edge of said lower part and a mounting part which extends outwardly with respect to said lower part of the suitcase from said base leg portion, said mounting part including a bulbous tip, said lip element including a groove between the bulbous tip and the base leg portion, the side of said groove formed by said base leg portion slanting downwardly towards said groove, a plastic band element mounted on the mounting portion of said lip element, said plastic band element being flexible and including two leg portions which extend away from one side thereof and towards each other, said two leg portions snap fitting around said bulbous tip of the mounting portion, said plastic band element being shaped to contact and seal against the outer surfaces of said lower and upper parts of the suitcase when they are closed and to concurrently conceal said butt joint.

2. The suitcase as defined in claim 1 wherein said plastic band elememt includes a metal foil embedded therein.

3. The suitcase as defined in claim 1 wherein said plastic band element is made of cellulose acetobutyrate.

4. The suitcase as defined in claim 1 wherein said plastic band element is made of polyvinyl chloride.

5. The suitcase as defined in claim 1 wherein the side of said plastic band element opposite said leg portions is smooth in contour.

6. The suitcase as defined in claim 1 wherein the side of said plastic band element opposite said leg portions includes a single raised rib portion.

7. The suitcase as defined in claim 1 wherein the side of said plastic band element opposite said leg portions has a corrugated contour.

8. The suitcase as defined in claim 1 wherein the two leg portions of said plastic band element include portions at their free ends which extend towards one another.

9. The suitcase as defined in claim 1 wherein said lip element includes a slanted, upwardly extending portion on the side of said base leg portion opposite said mounting portion.

10. The suitcase as defined in claim 9 wherein said lip element includes a supporting leg portion which extends along the inner surface of said frame means of said lower part of the suitcase and is connected thereto.

11. The suitcase as defined in claim 1 wherein glue is located between said plastic band element and said mounting portion of said lip element.

12. The suitcase as defined in claim 1 wherein said lip element is formed of two separate, interconnected parts.

13. The suitcase as defined in claim 1 wherein each of said lower and upper parts includes a covering material which covers the external surface of the respective frame means and extends over the respective abutment edge thereof, said lip element being in direct contact with the portion of the covering material of said lower part which extends over its associated abutment edge.

* * * * *